United States Patent [19]

Rempel

[11] 4,413,542

[45] Nov. 8, 1983

[54] MAT CUTTER AND GUIDE SYSTEM

[76] Inventor: Delmar Rempel, 1421 Egbert Ave., Saskatoon, Saskatchewan, Canada, S7N 2L8

[21] Appl. No.: 145,340

[22] Filed: Apr. 30, 1980

[51] Int. Cl.[3] ..... B26D 7/02; B26D 7/26; B26D 5/10

[52] U.S. Cl. ..... 83/455; 83/522; 83/614

[58] Field of Search ..... 83/614, 455, 522

[56] References Cited

U.S. PATENT DOCUMENTS

| | | | |
|---|---|---|---|
| 570,180 | 0/1896 | McCall . | |
| 3,130,622 | 4/1964 | Eno | 83/522 X |
| 3,213,736 | 10/1965 | Keeton | 83/455 |
| 3,463,041 | 8/1969 | Shapiro et al. | 83/614 X |
| 3,527,131 | 9/1970 | Ellerin et al. | 83/522 |
| 3,779,119 | 12/1973 | Broides | 83/614 X |
| 3,897,706 | 8/1975 | Martin | 83/455 |
| 3,967,519 | 7/1976 | Esterly | 83/455 |
| 3,973,459 | 8/1976 | Stowe | 83/455 |
| 3,996,827 | 12/1976 | Logan | 83/614 |
| 4,022,095 | 5/1977 | Jones | 83/455 |
| 4,096,631 | 6/1978 | Ward | 83/455 X |

*Primary Examiner*—D. R. Schran

*Attorney, Agent, or Firm*—Birch, Stewart, Kolasch & Birch

[57] ABSTRACT

A cutter for picture frame mats is provided herein. It includes a rectangular cutter base having a planar mat-supporting surface, a hinged frame, a cutter head assembly mounted on a guide rod on the hinged frame, and a stop on the guide frame. The inventive concept is embodied in a novel clamping frame including a pair of spaced-apart, parallel, transverse, lateral hinge bars, each being secured by an associated hinge adjacent its respective rear end. A longitudinally extending handle interconnects the respective forward ends of the transverse lateral hinge bars. A longitudinally extending intermediately transversely positioned cutter head guide bar assembly is disposed between the hinge bars. The cutter head guide bar assembly includes a guide plate having a lower surface which, in use, lies flush with the picture frame mat which is resting on the mat-supporting surface. A guide rod is secured to its upper surface, rotation in, and with respect to, the transverse, lateral hinge bars, at a point intermediate the forward end and the rearward end of the transverse, lateral hinge bars. Each such hinge has a first stop member cooperating with an associated hinge bar to limit rotation of the cutter head guide bar assembly and the clamping frame to an upright position at a selected angle within the range of from about 92°–96° to the plane of the cutter base. Each hinge also has a second stop member cooperating with an associated hinge bar to limit rotation of the cutter head guide bar assembly and the clamping frame to a lowered position at which the bottom surface of the guide plate is flush with, but is not resting with any significant weight upon, the picture frame mat which is resting on the mat-supporting surface. The clamping frame is thus selectively deformable by exerting downward pressure on the cutter head guide assembly thereby to urge the guide plate into gripping engagement with the picture frame mat. A mat guide system is also mounted on the cutter base to enable duplication and repeating of the same cutting procedures through a series of three steps in a duplicator block, repeater block and groover block mounted on a wide rigid central bar.

28 Claims, 9 Drawing Figures

MAT CUTTER AND GUIDE SYSTEM

BACKGROUND OF THE INVENTION (i) Field of the Invention

This invention relates to a cutter for mat boards used generally in the framing of pictures. The invention relates not only to the cutter itself, but also to a novel mat guide system for use with such cutter, to a novel squaring arm system to be used with the cutter, and to a novel slide block assembly to be used with such cutter.

(ii) Description of the Prior Art

Mat boards are formed from paper stock, e.g., cardboard, which are then provided with openings, either square or rectangular or other geometric shapes, of various size within which a picture is framed.

The problem existing in the art is to form a neat, accurate opening therein about the picture being framed. Because of the vast range of sizes of such openings, depending upon sizes of the picture being framed, it is highly desirable that any mechanical device utilized for this purpose must be quickly and accurately adjustable.

There are many mat cutting machines which have been designed and produced to meet this need. Many are expensive to make and complex to use. Some of the expensive machines provide an independent mechanism to control insertion of the blade into the mat at the proper bevel angle.

One such prior patent is McCall, U.S. Pat. No. 570,180 issued in 1896 for a "Bevel Edge Cardboard Cutter". The patent to McCall recognized that there is a problem in holding down the matting material during the cutting operation and therefore mounted his cutting guide rail pivotally so that the guide rail itself could help hold down the matting material.

Another proposal to solve such problem was suggested by Eno, in U.S. Pat. No. 3,130,622, patented Apr. 28, 1964, which provided a device for cutting rectangular holes in sheets wherein the marginal edges of the rectangular holes were of two different lengths.

Still another proposal to solve such problem was provided by Keeton in U.S. Pat. No. 3,213,736 issued Oct. 26, 1965. Because of its construction and mode of use, considerable difficulty was encountered not only in operation, but also, and more important, in seeking to obtain a clean cut, as well as a true and exact meeting of component edges at the corners of the cut without overcutting or undercutting. Moreover, Keeton used a long handle to engage the blade with the mat. This did not permit precise controlled engagement of the blade with the mat being cut. Furthermore, Keeton did not provide a convenient means for lifting the cutter head guide bar assembly. His system was unweildly and, if bent would warp the hinges, making control very difficult.

U.S. Pat. Nos. 3,463,041 to Shapiro et al and 3,527,131 to Ellerin et al alleged to provide mat cutting devices in which a rectangular mat opening was cut one side at a time. In the use of such devices, the opening was first marked on the mat and then the mat was turned and had to be accurately realigned with an edge guide for cutting each of the sides.

Broides, in U.S. Pat. No. 3,779,119 patented Dec. 18, 1973 alleged to provide a picture mat cutter which was provided with a number of adjustable stops and guides such that once the machine was adjusted, a quantity of identical mats might be cut with uniform borders on all four of their sides without readjusting the machine.

Martin, U.S. Pat. No. 3,897,706 patented Aug. 5, 1975, alleged to provide a cutter device for picture frame mats including an elongate base having an upper surface on which the sheet material to be cut was placed, and an elongated clamp bar which was coextensive with the base and which held the sheet material in place.

The clamp bar had a slidable carriage which mounted a pair of cutting blades.

Esterly, in U.S. Pat. No. 3,967,519 patented July 6, 1976, alleged to provide a web cutting apparatus wherein a multi-sided figure was cut into the web without having to re-position the web or to mark the same.

Stowe, in U.S. Pat. No. 3,973,459 patented Aug. 10, 1976, provided a mat cutter including a guide rail which was pivotally mounted by a pair of elongated L-shaped bars to the outside edges of the cutting board.

Logan, in U.S. Pat. No. 3,996,827 patented Dec. 14, 1976, alleged to provide a cutter for mat frames which included a cutter head, including a pair of blade-carrying cutter blocks, slidable along a cutter bar and having a plurality of adjustable stops for accurately positioning and cutting of a mat board without over or under cutting. Logan provides a handle system and a cam system within the cutter head. However, the handle of Logan does not provide any control over the actual cutting.

Jones, in U.S. Pat. No. 4,022,095 patented May 10, 1977, alleged to provide a mat cutter including a guide rail, a blade and a blade guide, a portion of the blade protruding below the blade to engage in and cut a cardboard mount or the like below the guide.

Ward, in U.S. Pat. No. 4,096,631 patented June 27, 1978, alleged to provide a mat cutting machine including a base and a guide rail, including a straight edge. A carriage was mounted upon the guide rail in a removable and slidable fashion, the carriage including a cutting blade.

A difficulty encountered with many of the abovementioned mat cutting machines was that their sliding surfaces, if not used regularly, tended to become oxidized or corroded, impeding the smooth sliding action necessary to produce a properly cut mat.

As will be clear from the above description, in spite of the large number of patents issued in this field, there are still a number of problems which need to be solved. It is still difficult to assure that the cut mat be truly parallel with the cutter bar. In addition, a problem exists in truly duplicating the first set of cuts in subsequent sets of cuts. Additionally, it would be desirable to be able to cut V-grooves in the mat and yet to be able to return to the exact position as in the previous cut. It would also be desirable readily, simply and accurately to increase or decrease the size of the mat opening.

Moreover, the mat cutter should be particularly designed and constructed to facilitate the entire preparation of matting material for picture framing from the step of sizing the material to be completed bevel cut for framing the picture. The mat cutter should furthermore be designed for cutting out an opening, in, i.e., a portion of the sheet within the outer contour of the sheet. In addition, the cutting device should be arranged so that the edge of the aperture cut in the cardboard can be inclined to the surface of the mount by an angle which is not equal to 90°. The object is to provide a bevelled edge to the aperture which is visible when the picture or photograph is viewed, the function of the vevelling being to give a feeling of depth when the picture or photograph is viewed.

SUMMARY OF THE INVENTION (i) Aims of the Invention

Accordingly, a primary object of this invention is the provision of a mat cutter which may be quickly and accurately adjusted and which is relatively foolproof in its operation.

Another object of this invention is to provide the apparatus with a cutter bar that is so mounted as to hold the mat board being cut against displacement.

A further object of the present invention is to provide a mat cutter which can both trim the edges of the sheet and also form interior cuts in the sheet, so as to assure parallelism between the interior cuts and the edges.

Still another object of this invention is the provision of a mat cutter designed to form cuts having starting points and/or end points which are located accurately predetermined distances from the edges of the sheet.

A further object of the present invention is to provide a mat cutter which is capable of cutting a quantity of identical mats, one at a time, with uniform borders on all four of their sides, and without the need for readjusting the machine as the work progresses.

Another object of this invention is to provide a guide system for a mat cutter which includes a suplicator, a repeater and a groover all on the same bar which permits duplicating and repeating of the same cutting procedures.

Another object of this invention is to provide such a system which is a true parallel system operative off one central bar which is rigid enough and wide enough to maintain its parallelity.

A further object of this invention is to provide a mat cutter in which the cutter head may be rotated to facilitate blade changing.

Another object of this invention is to provide a mat cutter which permits easy access to enable placement of the mat boards.

(ii) Statements of Invention

This invention provides a mat cutter for picture frame mats, the cutter comprising: (a) a rectangular cutter base having a planar mat-supporting surface; (b) a clamping frame including a pair of spaced-apart, parallel, transverse, lateral hinge bars each being secured by an associated adjacent its respective rear end, a longitudinally extending handle interconnecting the respective forward ends of the transverse, lateral hinge bars, and a longitudinally extending intermediately transversely positioned cutter head guide bar assembly disposed between the hinge bars, the cutter head guide bar assembly including a guide plate having a lower surface which, in use, lies flush with the picture frame mat resting on the mat-supporting surface and a guide rod secured to its upper surface, the guide rod being journalled for selective restrictive rotation in, and with respect to, the transverse, lateral hinge bars, at a point intermediate the forward end and the rearward end of the transverse, lateral hinge bars, each hinge means having a first stop member cooperating with an associated hinge bar to limit rotation of the cutter head guide bar assembly and the clamping frame to an upright position at a selected angle within the range of from about 92°–96° to the plane of the cutter base, and each hinge means having a second stop member cooperating with an associated hinge bar to limit rotation of the cutter head guide bar assembly and the clamping frame to a lowered position at which the bottom surface of the guide plate is flush with, but is not resting with an significant weight upon, the picture frame mat which is resting on the mat-supporting surface, the clamping frame being selectively deformable by exerting downward pressure on the cutter head guide assembly, thereby to urge the guide plate into gripping engagement with the picture frame mat; (c) a cutter head slidably mounted along the guide rod by means of a replaceable bearing block, the cutter head including spaced-apart longitudinal edges, one of the edges forming an acute angle to the plane of the base and the other forming approximately a right angle to the plane of the base, the cutter head including a pair of cutting blades pivotally carried thereby, one blade being disposed for guidance by, and cooperation with, each longitudinal edge of the cutter head; and (d) a pair of longitudinally spaced-apart, longitudinally slidably, adjustably, movable, fixable, but detachable stop means, each being mounted on the guide rod to limit to-and-fro slidable movement of the cutter head along the guide rod.

(ii) Other Features of the Invention

By one feature of this invention the guide rod is journalled for rotation with an associated bearing block, each secured to an associated transverse, lateral hinge bar.

By another feature, the longitudinally extending handle interconnecting the respective forward end of associated such transverse, lateral hinge bars comprises a hollow bar of generally rectangular cross section.

By another feature of this invention, each hinge means comprises: (a) a hinge member comprising a generally rectangular, transversely extending bar inset into a channel at a respective lateral edge of the base, the bar including a rectangular well adjacent its forward end, one longitudinally extending edge of the rectangular well defining the first stop means, and the other longitudinally extending edge of the rectangular well defining the second stop means, the central well being provided with a journal bore therein for accepting a hinge pin.

By a further feature, the transverse, lateral hinge bar comprises: a rearwardly projecting, downwardly extending leg pivotally secured by a hinge pin passing through a bore in the leg and the journal bore in the central well, and a forwardly extending integral upper arm spaced a predetermined distance above the hinge means.

By a further feature, each hinge bar is provided with a depending bearing block and the guide rod is journalled for rotation within bearings disposed in the bearing block.

By a further feature, the cutter head guide bar assembly comprises a guide plate, and a guide rod secured thereto on the upper surface thereof, the guide rod being journalled for selective rotation with respect to the transverse, lateral hinge bars through an angle of 45°.

The detachable stops, according to another feature of this invention each comprise: (a) a main body portion; (b) a generally circular channel in the bottom thereof to enable slidable movement of the main body portion along the guide rod, and the channel including securement means for fixing the main body portion at a selected longitudinal position along the guide rod; (c) a lower fixed stop bar secured to the bottom of the main body portion; and (d) an upper movable stop bar provided with a projecting stop pin, the stop bar being adjustably slidably movable along the upper surface of the main body portion and the bar including fixing means for fixing the stop bar at a selected longitudinal position with respect to the main body portion. Such means for fixing the main body portion with respect to the guide rod preferably comprises a set screw.

By another feature, the upper movable stop bar is slidably disposed within a longitudinal channel in the top surface of the main body portion and is held therein by a retaining plate, the main body portion including retaining means to retain the movable stop bar at any selected position with respect to the main body portion. Such retaining plate preferably is a transparent plastic plate, and the retaining means comprises a set screw.

A replaceable bearing block, according to another feature of this invention, is formed of a structurally rigid, substantially frictionless synthetic material set into the base thereof. The edge forming approximately a right angle to the plane of the base is constituted by a vertical cutting head having the blade secured therein, the vertical cutting head being pivotally mounted along a generally vertical face disposed at a slight downwardly and inwardly directed angle, the vertical cutting head being spring biased to remain in an upper, non-engaged position. A side face of the blade which is held by the vertical cutting head is acted on by the internal end face of a set screw.

The edge forming an acute angle to the plane of the base is constituted by a bevel cutting head having the blade secured therein, the bevel cutting head being pivotally mounted along a face disposed downwardly and outwardly at a 45° angle, the bevel cutting head being biased to remain in an upper, non-engaged position. A side face of the blade which is held by the bevel cutting head is acted on by the internal end face of a set screw.

The mat cutter, according to a further feature of this invention also includes a squaring arm comprising: (a) a "Tee" cross-section arm secured to the rear edge of the rectangular cutter base at exactly right angles thereto, by a flat base portion, the "Tee" cross-section arm having an upwardly extending arm; (b) a production stop block adjustably slidably mounted on the "Tee" cross-section arm, the production stop block having retaining means to retain the production stop block at a selected location; and (c) a retainer pin projecting from the inboard end of the production stop block. The squaring arm preferably includes a scale secured to the upper surface of the flat base portion of the "Tee" cross-section arm.

The mat cutter according to a still further feature of this invention also includes a mat border measuring and guide system comprising: (a) a main support arm secured in a fixed position to the forward edge of the rectangular cutter base and extending at an angle of exactly 90° thereto; (b) a main block slidably secured to the main support arm between the inboard end of the main support arm, the main block including securement means to retain the main block at a first selected position along the main support arm; (c) a rectangular extension arm adjustably slidably secured to the inboard end of the main block, the extension arm including securement means to retain the rectangular extension arm at a preselected position on the main block; (d) a squaring ruler secured to the inboard end of the extension arm at exactly 90° thereto; (e) a duplicator rod extending outwardly from the maim block and including securement means to retain the duplicator rod at a preselected position relative to the main block; (f) a duplicator block having a longitudinally extending bore slidably receiving the duplicator rod and being slidably secured to the main support arm inboard of the repeater block, the duplicator block including securement means to retain the duplicator block at a first selected position along the main support arm; and (g) a repeater block having a longitudinally extending bore slidably receiving the duplicator rod and being slidably secured to the main support arm adjacent the rearward end thereof, the repeater block including securement means to retain the repeater block at a second, different selected position along the main support arm; whereby the squaring ruler, the rectangular extension arm and the main block are slidable, as a unit, between a position a preselected distance from the duplicator block, the duplicator block being either a preselected distance from the repeater block, or abutting the repeater block.

By other features, the main support arm comprises a rectangular bar having an engageable longitudinally extending edge; the repeater block comprises a block including a bottom, longitudinally extending channel to enable the repeater block to slide with respect to the rectangular bar, and the securement means comprises a set screw passing through a side face of the repeater block for engagement with the engageable, longitudinally extending edge; the duplicator block comprises a block including a bottom, longitudinally extending channel to enable the duplicator block to slide with respect to the rectangular bar, and the securement means comprises a set screw passing through a side face of the duplicator block for engagement with the engageable, longitudinally extending edge; the main block comprises a block including a bottom, longitudinally extending channel to enable the main block to slide with respect to the rectangular bar, and the securement means comprises a set screw passing through a side face of the block for engagement with the engageable, longitudinally extending edge; the rectangular extension arm is secured to the main block by a pair of longitudinally extending slots therein through which a respective pair of screws pass, the screws being engageable in respective tapped apertures in the main block; and the squaring ruler includes a slider pad adhered to the bottom surface thereof.

The guide system according to another feature of this invention also includes a groover block adjustably slidably mounted on the extension arm, the groover block including retainer means to retain it at a selected position relative to the extension arm.

In such guide system, the main extension arm comprises a rectangular bar having an engageable, longitudinally extending arm; and the groover block comprises a "Tee cross-section block 38, having an upwardly extending arm abutting a longitudinal side face of the main extension arm, and including a longitudinally extending slot in the main extension arm and a screw passing into a tapped aperture in the flat face.

By another feature, an improved mat cutter is provided in which: (a) the main support arm comprises a rectangular bar having an engageable longitudinally extending edge; (b) the repeater block comprises a block having a bottom, longitudinally extending channel to enable the repeater block to slide with respect to the rectangular bar, and the securement means comprises a set screw passing through a side face of the repeater block for engagement with the engageable, longitudinally extending edge; (c) the duplicator block comprises a block including a bottom, longitudinally extending channel to enable the cuplicator block to side with respect to the rectangular bar, and the securement means comprises a set screw passing through a side face of the duplicator block for engagement with the engageable, longitudinally extending edge; (d) the main block comprises a block including a bottom, longitudinally extending channel to enable the main block to slide with respect to the rectangular bar, and the securement comprises a set screw passing through a side face of the block for engagement with the engageable, longitudinally extending edge; (e) the rectangular extension arm is secured to the main block by a pair of longitudinally extending slots therein through which a respective pair of screws pass, the screws being engageable in respective tapped apertures in the main block; (f) the squaring ruler includes a slider pad adhered to the bottom surface thereof; and including (g) a groover block adjustably slidably mounted on the extension arm, the groover block including retainer means to retain it at a selected position relative to the extension arm, the groover block comprising a "Tee cross-section block", having an upwardly extending arm abutting a longitudinal side face of the main extension arm by means of a longitudinally extending slot in the main extension arm and a screw passing into a tapped aperture in the flat face.

BRIEF DESCRIPTION OF THE DRAWINGS

In the accompanying drawings.

DESCRIPTION OF PREFERRED EMBODIMENT (i) Generalized Description of FIGS. 1-4

Figure 1:
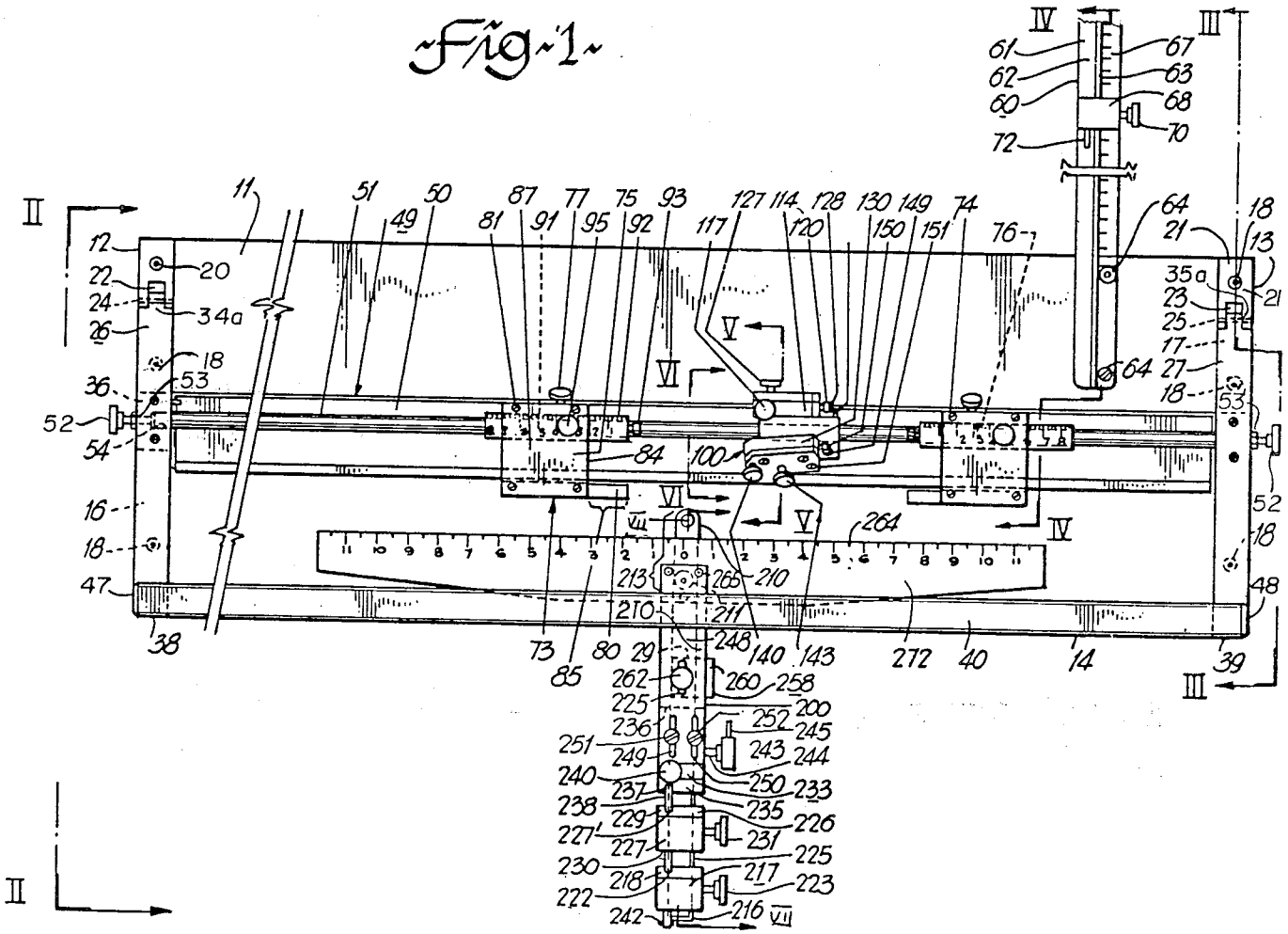
FIG. 1 is a top plan view of the entire mat cutter of one embodiment of this invention including a mat guide assembly, a squaring arm assembly, a cutter block assembly and a detachable stop assembly.

As seen in FIG. 1, the mat cutter 10 generally consists of a rectangular planar mat-supporting base 11 having a pair of side edges 12, 13, a front edge 14 and a rear edge 15. Secured within a respective transverse channel 16, 17 in a respective side edge 12, 13 by three screws 18 in spaced-apart apertures 19 is a respective pair of transversely extending hinge means 20, 21, each having a respective rectangular central well 22, 23, provided with a respective transverse journal bore 24, 25 the lateral portions around well 22, 23. A respective pair of hinge means 26, 27 including an upper main arm portion 28, 29, which is vertically spaced from, and parallel to, respective hinge means 20, 21 and an angularly depending rearwardly extending leg 30, 31, is pivoted to the respective hinge means 20, 21 by means of hinge pins 32, 33 passing through bores 34, 35 in tangries **34*a*, 35*a* in legs 30, 31 and journal bores 24, 25. A pair of bearing blocks 36, 37 is suspended from main arms 28, 29 respectively of hinge bars 26, 27 for a purpose to be described hereinafter. Interconnecting the forward free ends 38, 39 of the respective main arms 28, 29 of hinge bars 26, 27 is a longitudinally extending forward handle 40, of hollow rectangular cross-section, secured to the respective main arms 28, 29 by a screw/nut combination 40, and countersunk holes 45, 46 in main arms 28, 29. The handle 40 is provided at each end, with a respective end cap 47, 48**.

(ii) Description of Cutter Guide Bar Assembly

The mat cutter 10 is provided with a longitudinally extending cutter head guide bar assembly 49 including a guide plate 50 and a guide rod 51 secured thereto by tension pins 52. The guide rod 51 extends longitudinally beyond the lateral edges of guide plate 50 as mounting rods 53, 53'. These mounting rods 53, 53' are journalled for selective, limited rotation in bearings 54, 55' which are secured within bearing blocks 36, 37. The guide plate 50 includes a lower face 56 which when in use lies perfectly flat on the picture frame mat lying on the planar work supporting base 11, as well as a forward longitudinally extending edge 57 cut at an angle of 45° thereto, and a rear longitudinally extending edge 58. The area of the planar work-supporting base below the rear longitudinally extending edge 58 is provided with a longitudinally extending groove 59.

Figure 4:
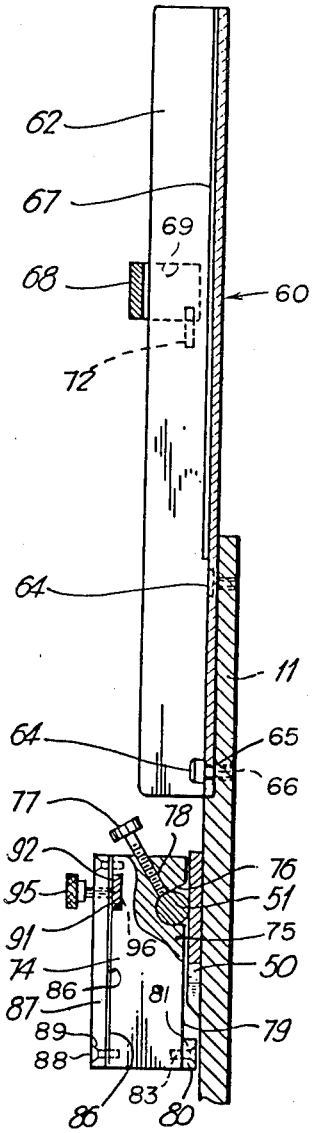
FIG. 4 is a cross-section along line IV—IV of FIG. 1 through the squaring assembly and a detachable stop assembly.

Slidably mounted on the longitudinal guide rod 50 are a pair of opposed detachable stops 73, 74 (as also seen in FIG. 4). Each detachable stop 73, 74 includes a main block 75 having a longitudinally extending semicylindrical lower guideway 76 by means of which block 75 is slidable on guide rod 51. The block 75 is secured at a selected location on guide rod 51 by means of set screw 77 threadedly mounted in tapped aperture 78 in block 75. Secured to the bottom surface 79 of block 75 is a lower stop plate 80 by means of screws 81 in countersunk holes 82 on lower stop plate 80 and aligned holes 83 in block 75. Lower stop plate 80 projects beyond an inner face 84 of the block 75 by a predetermined amount 85. Similarly, secured to the top surface 86 of block 75 is a retaining plate 87, preferably made of a clear transparent synthetic plastics material, e.g., a polymethylmethacrylate known by the trade mark PLEXIGLASS. Retaining plate 87 is secured to block 75 by screws 88 passing through countersunk holes 89 in plate 87 and aligned holes 90 in block 75. The upper surface 86 of block 75 is provided with a longitudinally extending channel 91 and slidably mounted in channel 91 is a top scaler member 92 (e.g., a ruler marked in cm and in.).

Each stop scaler member 92 has its associated slide limit bolt 93 projecting from a facing end 94 thereof. The stop scaler member 92 is adjusted to the required position and is held in place by a set screw 95 threadedly mounted in tapped hole 96 in plate 87.

(iii) Operation of Cutter Guide Bar Assembly

The cutter head guide bar assembly just described provides a swivelling action which has many advantages. As the cutter head is lifted it tilts forwardly, thus enabling easy access to the cutter head for a purpose to be described later. When it is placed back down onto the mat board, the swivelling action forces the mat against the guide as the handle reaches its most downward and level position. This keeps the mat in its proper position at all times. The handle permits pressure being applied during the cutting period, further assuring that the mat is kept in its proper position.

Figure 5:
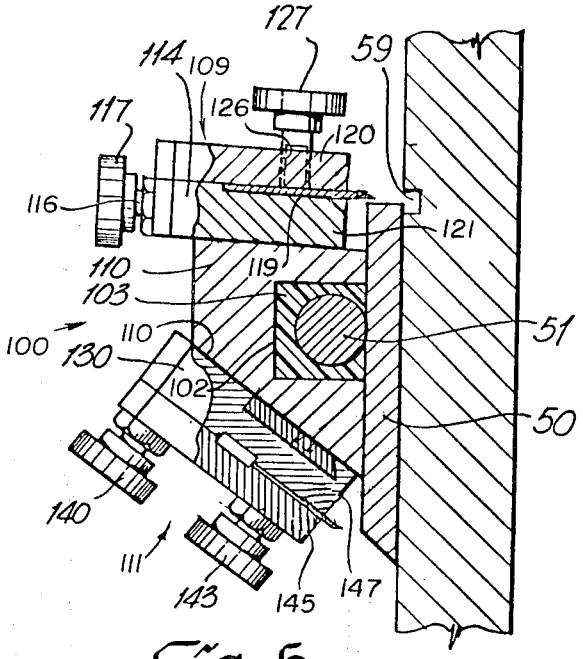
FIG. 5 is a cross-section along the line V—V of FIG. 1 through the cutter block assembly.
Figure 6:
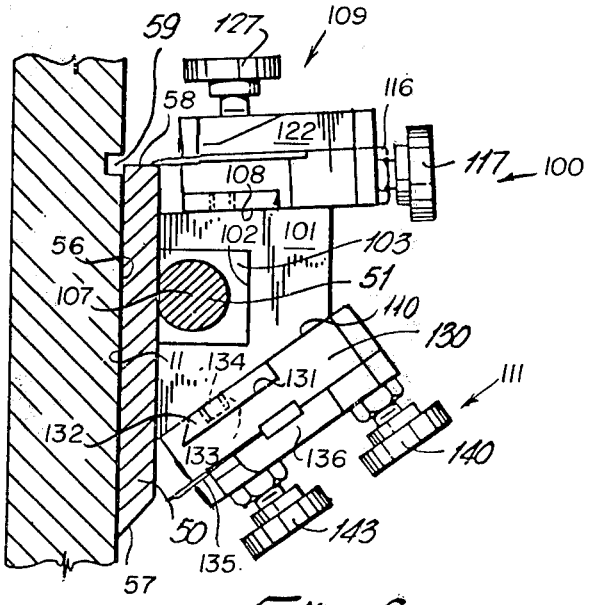
FIG. 6 is an elevational view as viewed along the arrows VI—VI of FIG. 1, showing the cutter block assembly.

(iv) Description of Slider Block Assembly (FIGS. 5 and 6

Also slidably mounted on the guide rod 50 is a slider block assembly indicated generally by reference numeral 100 (as as also seen in FIGS. 5–8). Slider block assembly 100 includes a main slider block 101 provided with a rectangular channel 102 within which a slider block bearing 103 is secured. Block bearing 103 is provided with an almost cylindrical slideway 107 by means of which block 101 is adapted to slide along guide rod 51. Block bearing 103 is made of any suitable structurally rigid substantially frictionless material, one example of which is the material known by the trade mark OILON.

The slider block 101 is provided with a "vertical face" 108 to which a vertical cutting head 109 is pivotally mounted and a bevel face 110 to which a bevel cutting head 111 is pivotally mounted. While face 108 is termed a "vertical face" it is in fact slightly angled, i.e., it slopes downwardly and inwardly by from 3°–4°. Face 110 slopes downwardly and outwardly by from 35°–40°. Moreover, while the longitudinal edge 112 of face 108 is parallel to the central longitudinal axis of block bearing 103, the longitudinal edge 113 of face 110 is offset from the longitudinal axis of block bearing 103 by an amount of 2°–3°.

The vertical cutting head 109 includes a main plate 114 provided with a pivot pin 115 by means of which it is pivotally secured to block 101. Main plate 114 is locked onto block 101 by means of locking member 116 acted upon by set screw 117 threadedly mounted in tapped aperture therein. Main plate 114 is provided with a blade-accepting channel 119, within which a blade 20 is disposed. To assure that a cutting edge of the blade will be exposed, a corner of the main plate 114 is cut away at a 45° angle at 121.

A cover plate 122 is provided to cover and secure blade 120 within the vertical cutting head 109. Cover plate 122 is held onto main plate 114 by means of screws 124 passing through countersunk holes 124 in cover plate and aligned tapped apertures in main plate 114. A portion of the inside face of cover plate is cut away at an angle of 45° to assure exposure of the blade 120. Also threadedly secured to cover plate 122 via tapped hole 126 is a set screw 127 which is adapted to provide face pressure to blade 120.

Vertical cutting head 109 is biased to the upper, non-cutting position by means of a tension spring engaged between a pin on cutting head 109 and a pin on block 101. During the cutting stage, a cammed locking attachment may be turned to lock the cutter in its cutting position, and may be rapidly released at the end of the cut.

The bevel cutting head 110 includes a main block 130 provided with an interior guideway 131. Within guideway 131 is spline 132 having a bearing hole 133 within which pin 134 secured to face 110 is adapted to fit. In this way, main block 130 is pivotally secured to block 101. The outer face of main block 130 is provided with a blade-accepting channel 134 within which is secured a blade 135. Blade 135 is held in place by means of a cover plate 136 which is secured to main block 130 by screws 137 passing through countersunk holes 138 in cover plate 136 and into aligned tapped holes in main block 130. An anchoring set screw 140 is threadedly secured to cover plate 136 and to main block 130 through aligned tapped holes. In addition, a pressure application to the blade 135 is provided by a set screw 143 passing through a tapped aperture in cover plate 136.

In order to assure adequate exposure of the cutting edge of blade 135, a portion of one edge of main block 130 is provided with a 45° angled edge 145 and a semi-circular face, while a portion of one edge of cover plate 136 is provided with a 45° angled edge 147, which is interiorly chamfered.

Bevel cutting head 110 is biased to the upper, non-cutting position by means of a tension spring engaged between a pin in main block 130 and a pin in block 101. During the cutting stage, a cammed locking attachment may be turned to lock the cutter in the cutting position, and may be rapidly released at the end of the cut.

Thus, it is seen that slider block assembly 10 is provided with a pair of blade holders 109, 111, which can be selectively pivoted downwardly to cause the respective blades 120, 135 to cut a mat while being guided along a respective longitudinal edge 58, 57 of the guide bar 50 and while slidably movable along the guide rod 51.

(v) Operation of the Slider Block Assembly

Firstly, reverting back to the description of the cutter guide bar assembly, when the bar is tilted the slide block assembly is clearly accessible for changing of blades.

In the upper right hand corner of the knife holder is a small Allen screw. Releasing the pressure on the other two screws holding the top blade holder together on the cutter head, and turning the Allen screw clockwise permits the top of the knife holder to tilt outwardly at the top and to tilt inwardly at the bottom. Then the other two screws are tightened. This permits the blade to track more closely to the cutter bar.

In use, the cutter head is not drawn along the mat being cut by means of any handle. In the cutter head of this invention, a pull screw is provided which is just large enough for the tip of the forefinger of the user to be curled around. In order to draw the cutter head along the mat for cutting, the hand of the user is cupped around the cutter head. Pressure is applied by means of the use of the entire hand with a downward inward pressure, while drawing the cutter head by means of engagement by the tip of the forefinger with the pull screw.

Figure 2:
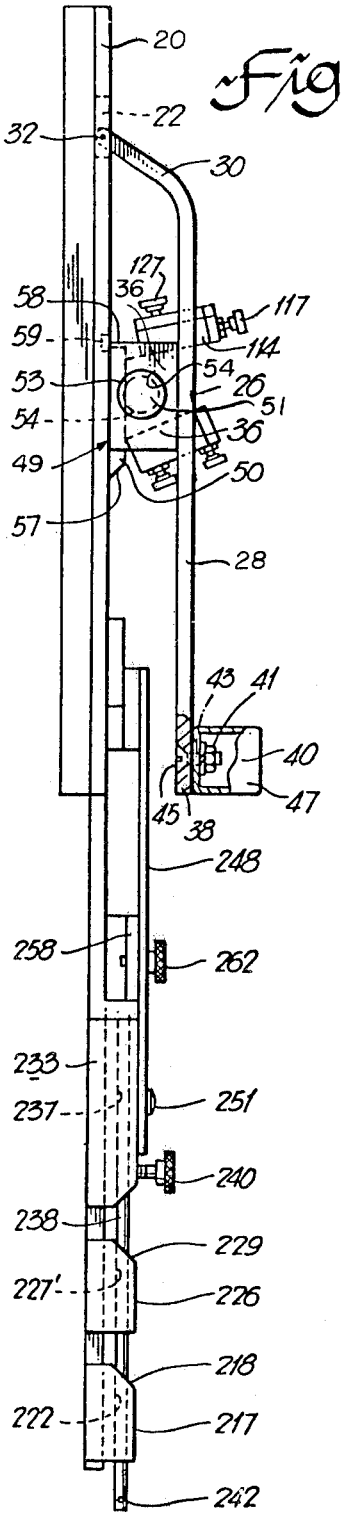
FIG. 2 is a side elevational view as viewed along the arrows II—II of FIG. 1.
Figure 3:
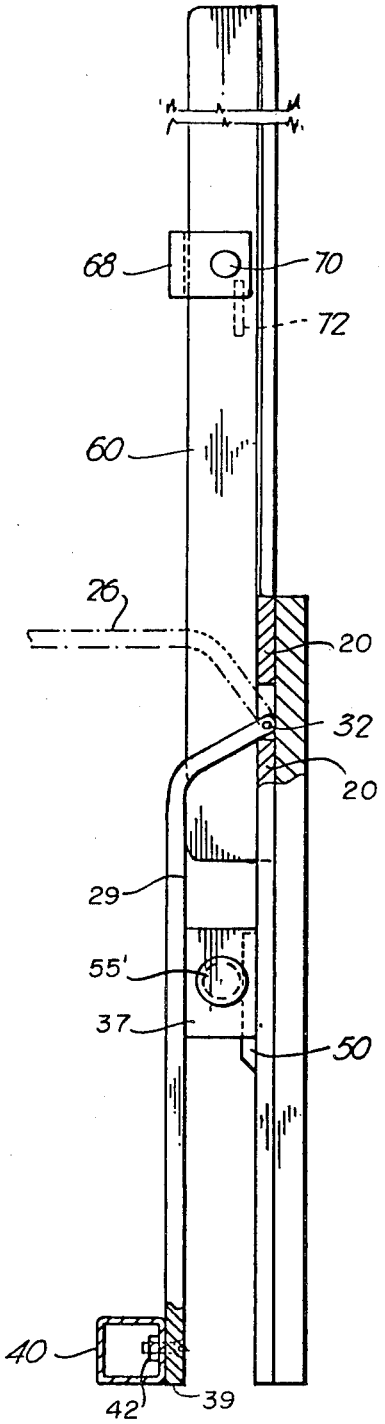
FIG. 3 is a partial cross-section and partial side elevation along the line III—III of FIG. 3.
Figure 7:
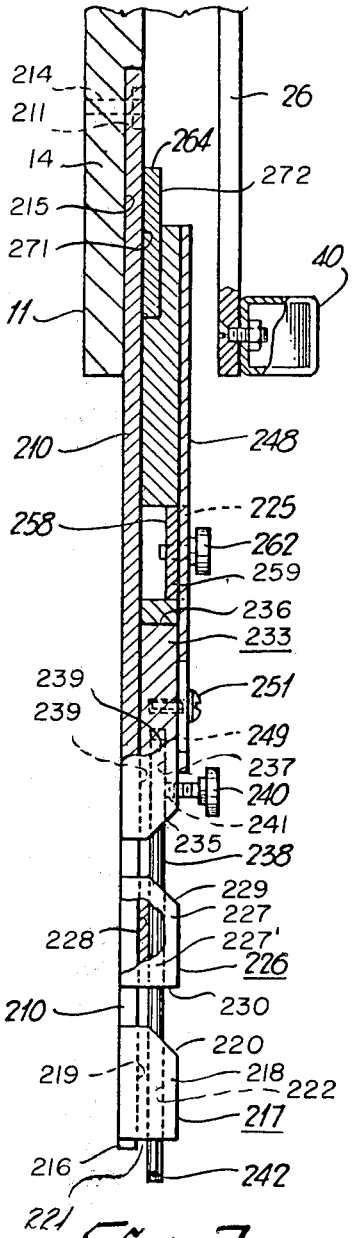
FIG. 7 is a section along the line VII—VII of FIG. 1 through a mat guide system.

(vi) Description of the Guide System (FIGS. 1, 2 and 7)

The mat cutter and guide system 200 includes a main rectangular support arm 210 which is secured to the forward edge 14 of the mat cutter base within a recessed channel 215 by means of bolts 211 passing through countersunk spaced-apart apertures 212 at the forward end 213 thereof and aligned holes 214 with recessed channel adjacent forward edge 14, (all as more clearly seen in FIG. 7).

Adjacent the rearward end 216 of the support arm 210 is a repeater 217 in the form of a block 218 which is provided with a lower, longitudinally extending rectangular guideway 219, to enable sliding movement along the rectangular support arm 210. Block 218 is provided with a forward chamfered face 220, a rear flat face 221, and a longitudinal bore 222 (whose purpose will be explained hereinafter) extending between faces 220 and 221. The location of the repeater 217 along the support arm 210 is set by means of set screw 223 passing through a tapped hole in block 218, to engage with a longitudinal edge 225 of support arm 210.

Disposed adjustably forwardly of the repeater 217 is a duplicator 226 defined by block 227 which is provided with a lower longitudinally extending rectangular guideway 228, to enable sliding movement along the support arm 210. The forward face of block 226 is provided with a chamfered face 229, while the rearward face 230 of block 226 is flat. A longitudinally extending bore 227' (whose purpose will be explained hereinafter) extends between faces 229 and 230. The location of the repeater 227 along the support arm 210 is set by means of set screw 231 passing through a tapped hole in block 227 to be engaged with longitudinal edge 225 of support arm 210.

Disposed adjustably forwardly of duplicator 226 is a main block 233 provided with a lower rectangular guideway 234 by which the main block 233 is slidable along the rectangular support arm 210. The rearward face of block 233 is provided with a chamfered face 235, while the forward face 236 of block 233 is flat. A longitudinally extending bore 237 extends between faces 235 and 236. A duplicator rod 238 is adjustably disposed through aligned bores 222, 227' and 237 by means of its forward end 239 being engaged by vertical set screw 240 extending downwardly through tapped aperture 241 in main block 233, and retained beyond flat face 221 of repeater 217 by transverse spring tension pin 242. The location of the main block 233 along the support arm 210 is set by means of transverse speed knob 243 held onto threaded shaft 244 by pin 245 passing through a tapped hole in speed knob 243. In turn, shaft 244 passes through a tapped hole in main block 233 to be engaged with longitudinal edge 225 of support arm 210. Speed knob 243 enables rapid engagement and disengagement of the main block 233 from the support arm 210.

Slidably supported on main block 233 is a rectangular extension arm 248. Extension arm 248 is provided with a pair of parallel longitudinal slots 249, 250 through which screws 251, 252 pass into tapped apertures in main block 233. A third central longitudinally extending slot 255 is also provided whose purpose will be explained hereinafter.

Mounted in slot 255 is a groover 258 in the form of a "Tee"-shaped block having a flat face 259, an arm 260 upstanding beyond the upper surface of main block 233 at the side edge thereof and a short base leg projecting below main block 233 at the side edge thereof. Groover block 258 is slidably adjustably secured to extension arm 248 by means of set screw 262 threadedly engaged in a tapped hole in face 259.

A squaring ruler 264 is secured to the extension arm by means of screws 265 passing through holes in squaring ruler 264 and into tapped holes in extension 248.

To facilitate sliding of the squaring ruler 264 on the planar surface 11, a slider pad 271 is adhered to the bottom of the squaring ruler 264. In addition, squaring ruler 264 is provided with label 272 adhered to the front face thereof.

Figures 8, 9:
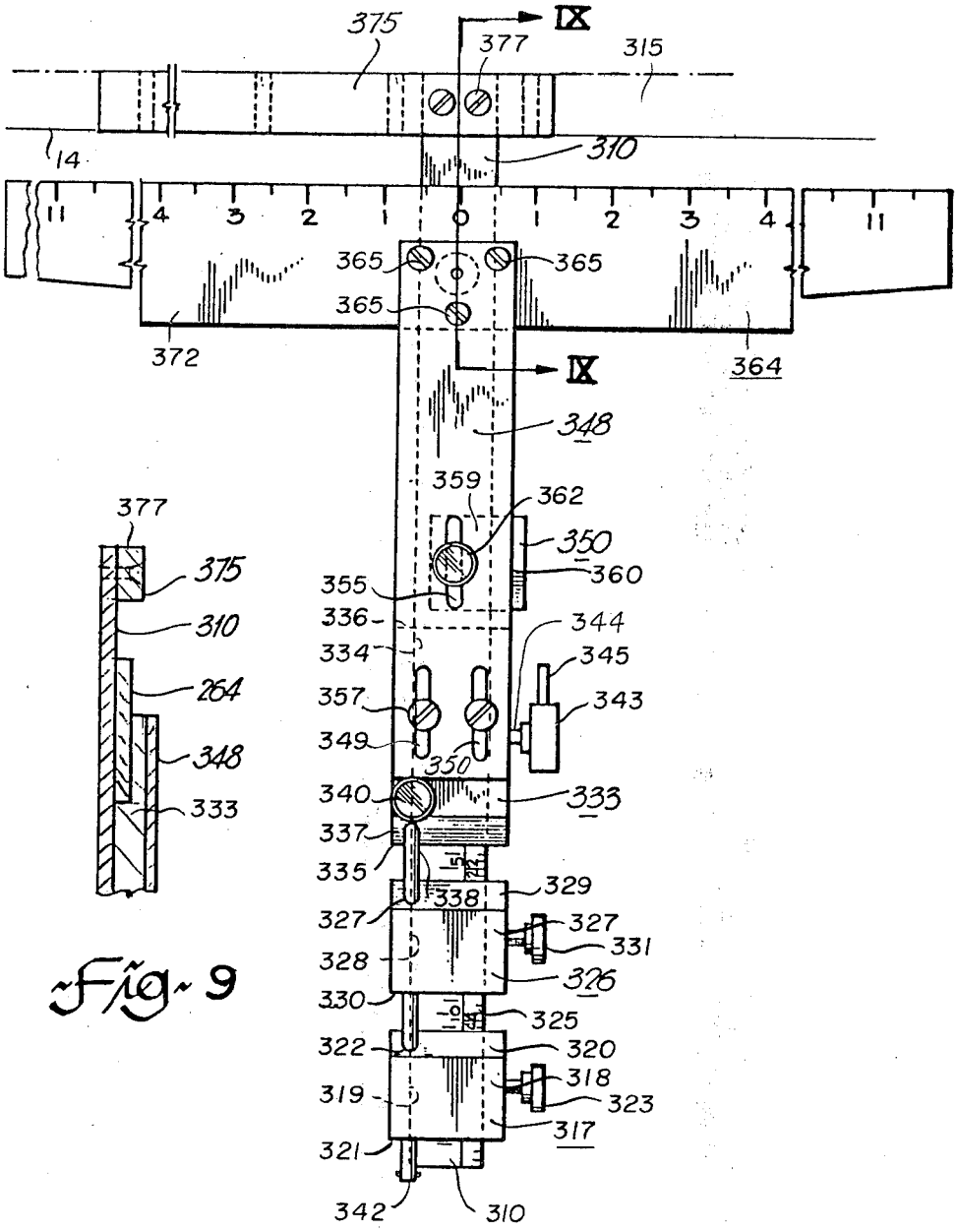
FIG. 8 is a top plan view of the mat guide assembly of this invention.
FIG. 9 is a section along the line IX—IX through the mat guide system of FIG. 8.

(vii) Description of Second Embodiment of Guide System FIGS. 8 and 9

As seen in FIGS. 8 and 9, a variant of the previously described mat cutter and guide system 200 is embodied by the mat cutter and guide system 300 which includes a main rectangular support arm 310 secured to a further mounting bar 375 secured to the inboard end of support arm 310 by means of bolts 377 passing through aligned apertures 378 to be at exactly 90° to the support arm 310, and adapted to abut a transverse ledge indicated by dash-and-dot lines. Mounting bar 375 is disposed in channel 315 running parallel to the forward edge 14 of the mat cutter base by means of bolts passing through countersunk spaced-apart apertures at the forward end thereof and aligned holes within a channel adjacent forward edge 14.

Adjacent the rearward end 316 of the support arm 310 is a repeater 317 in the form of a block 318 which is provided with a lower, longitudinally extending rectangular guideway 319, to enable sliding movement along the rectangular support arm 310. Block 318 is provided with a forward chamfered face 320, a rear flat face 321, and a longitudinal bore 322 (whose purpose will be explained hereinafter) extending between faces 320 and 321. The location of the repeater 317 along the support arm 310 is set by means of set screw 323 passing through a tapped hole in block 318, to engage with a longitudinal edge 325 of support arm 310.

Disposed adjustably forwardly of the repeater 317 is a duplicator 326 defined by clock 327 which is provided with a lower longitudinally extending rectangular guideway 328, to enable sliding movement along the support arm 310. The forward face of block 326 is provided with a chamfered face 329, while the rearward face 330 of block 326 is flat. A longitudinally extending bore 327 (whose purpose will be explained hereinafter) extends between faces 329 and 330. The location of the repeater 327 along the support arm 310 is set by means of set screw 331 passing through a tapped hole in block 327 to be engaged with longitudinal edge 325 of support arm 310.

Disposed adjustably forwardly of duplicator 326 is a main block 333 provided with a lower rectangular guideway 334 by which the main block 337 is slidable along the rectangular support arm 310. The rearward face 335 of block 333 is chamfered, while the forward face 336 of block 333 is flat. A longitudinally extending bore 337 extends between faces 335 and 336. A duplicator rod 338 is adjustably disposed through aligned bores 322, 327 and 337 by means of its forward end being engaged by vertical set screw 340 extending downwardly through a tapped aperture main block 333, and retained beyond flat face 321 of repeater 317 by transverse spring tension pin 342. The location of the main block 333 along the support arm 310 is set by means of transverse speed knob 343 held onto threaded shaft 344 by pin 345 passing through a tapped hole in speed knob 343. In turn, shaft 344 passes through a tapped hole in main block 333 to be engaged with longitudinal edge 325 of support arm 310.

Slidably supported on main block 333 is a rectangular extension arm 348. Extension arm 348 is provided with a pair of parallel longitudinal slots 349, 350 through which screws 351, 352 pass into respective tapped apertures in main block 333. A third central longitudinally extending slot 355 is also provided whose purpose will be explained hereinafter.

Mounted in slot 355 is a groover 358 in the form of a "Tee"-shaped member having a flat face 359, a long, upstanding arm 360 and a short base leg (not seen). Groover 358 is slidably adjustably secured to extension arm 348 by means of set screw 362 threadedly engaged in a tapped hole in face 359.

A squaring ruler 364 is secured to the extension arm through screws 365 passing through holes in squaring ruler 364 and into tapped holes in extension arm 348.

To facilitate sliding of the squaring ruler 364 on the planar surface 11, a slider pad (not seen) is adhered to the bottom of the squaring ruler 364. In addition, squaring ruler 364 is provided with a label 372 adhered to the front face thereof.

(viii) Description of the Squaring Arm Assembly (FIG. 4)

Secured to the rectangular base 11 is a squaring arm assembly 60 including a squaring arm 61 of "Tee"-shaped cross ection having a base 62 and an upright 63. The securement is by means of screw 64 passing through countersunk holes 65 in base 62 and aligned holes 66 in base 11. Base 62 is provided with a scale 67 (i.e., a ruler in cm. and in.). A production stop in the form of a block 68 is slidably disposed on upright 63 by means of channel 69, and is selectively and slidably held thereto by a set screw 70 passing through a tapped aperture in stop 68. A projecing pin 72 is provided to prevent any mat board (not shown) which may be warped from sliding out of place.

(ix) Use of the Mat Cutter and Guide System

It is possible to operate the guide system to cut a mat without the use of the detachable stops, i.e., only using the guide system and pencil marking technique. However it is preferred to use the guide system, and such use may be described as follows:

It is desired to cut a mat with a 2 inch border on the top and both sides, with a $2\frac{1}{2}$ inch border on the bottom, and then create a second mat to place underneath the first mat, with a $\frac{1}{4}$ inch smaller rectangular aperture, namely to provide a second mat with a $2\frac{1}{4}$ inch by $2\frac{3}{4}$ inch border, the following steps are followed sequentially:

If it is desired to cut a mat with a 2 inch border on the top and both sides, with a $2\frac{1}{2}$ inch border on the bottom, and then to create a second mat to place underneath the first mat, with a $\frac{1}{4}$ inch smaller, rectangular aperture, namely, to provide a second mat with a 2-1.4 inch by $2\frac{3}{4}$ inch border, the following steps are followed sequentially:

(1) Set the mat guide system on 2" on the bottom ruler.

(2) Set the duplicator on $2\frac{1}{2}$" on the bottom ruler.

(3) Set the repeater, $\frac{1}{4}$" out from the end of the duplicator.

(4) Mark the mat, using a 6H pencil on the back of the mat, with the guide on the 2", on the top and both sides of the mat.

(5) Now move the mat guide system toward and up to the duplicator, which is being held in place by means of the retaining knob on the bottom front.

(6) Mark the bottom, which is now at $2\frac{1}{2}$", and cut all four sides as per the lines drawn.

(7) Move out the duplicator to be in contact with the repeater. With a new sheet of mat board the same size as the first sheet, repeat the above procedures. This should show a double mat with the bottom one showing a $\frac{1}{4}$" lip on the inside.

(8) To create grooves in the knock-out, adjust the groover to the desired position as to the width of the V-groove required. When the groover is in place, the mat guide system may be moved back to cut and then be returned to its exact position. This is repeated until all four sides of the knock-out have been cut. The object of this cutting is to slice off a very narrow strip of the upper edge of the bevel. Upon completion of these steps, re-assemble the knock-out into the opening of the mat, re-adjust the guide and cut a new opening. The feature of this groover is that it permits the guide to be moved away and be returned to the exact position, cutting a very narrow groove without damage to the guide or blade.

In cutting a mat with 2 inch top and sides and $2\frac{1}{2}$ inch bottom opening using the detachable stops, the following procedure is followed: Place the mat with one side against the mat guide, and slide first upper detachable stop and its retaining bars against the top edge of the mat. Set the sliding ruler at 2 inches. Repeat these steps with the second upper detachable stop, but set the sliding ruler at $2\frac{1}{2}$ inches. Make a cut. Reverse the mat and the ruler setting and make a second cut. Then place the mat sideways with the mat guide system and the upper detachable stops at 2 inches. Make a cut. Slide the guide arm out to $2\frac{1}{2}$ inches, reverse the mat and make a final cut. Results: a rectangular opening 2 inches at the top and sides, and $2\frac{1}{2}$ inches at the bottom.

(x) Summary

Thus, it is seen that the mat cutting guide system of this invention provides a guide whereby the user may be able to cut mats: (a) in true parallel with the cutter bar; may (b) able to duplicate his first set of cuts; and may (c) be able to cut V-grooves, using the groover and be able to return to the exact position as his previous cuts or to increase the size of the hole opening in the mat, by moving the repeater outwardly. Moreover, the use of the detachable stop on the cutter bar eliminates the need for lines to be drawn in order to cut any rectangular opening. The detachable stops may be used on any cutter with a suitable diameter guide rod in any position throughout the length of this rod. Adjustment screws are provided on each end bearing to eliminate end movement.

It is also noted that the mat guide system of this invention provides all moving parts on one control bar and that this control bar has a ruler in both inches and metric. The retaining arm may be readily fastened to any existing mat cutter base.

The placement and design of the hinges holding the cutter head guide bar assembly are in such a manner as to permit it to stand in an open position at 92°–96°, e.g., 94°, thus eliminating damage of the mat board. The cutter head guide bar is journalled for rotation and thus has the ability to be stood on edge to facilitate removal and replacement of blades. The sliding block thereof is provided with a replaceable bearing. An attachment is secured to the cutter head to lock the cutter down when the cut is being made, with easy release at the end of the cut.

Finally, a detachable arm with a ruler and stop is provided to permit cutting of mats from full size down to required size. This stop has a pin to prevent mat board, which may be warped, from sliding out of place.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A mat cutter for picture frame mats comprising:

(a) a rectangular cutter base having a planar mat-supporting surface;

(b) a clamping frame including a pair of spaced-apart, parallel, transverse, lateral hinge bars, each being secured by an associated hinge means adjacent its respective rear end, a longitudinally extending handle interconnecting the respective forward ends of the transverse, lateral hinge bars, and a longitudinally extending intermediately transversely positioned cutter head guide bar assembly disposed between said hinge bars, said cutter head guide bar assembly including a guide plate having a lower surface which, in use, lies flush with said picture frame mat resting on said mat-supporting surface and a guide rod secured to its upper surface, said guide rod being journalled for selective restrictive rotation in, and with respect to, said transverse, lateral hinge bars, at a point intermediate the forward end and the rearward end of said transverse, lateral hinge bars, each said hinge means having a first stop member cooperating with an associated said hinge bar to limit rotation of said cutter head guide bar assembly and said clamping frame to an upright position at a selected angle within the range of from about 92°–96° to the plane of said cutter base, and each said hinge means having a second stop member cooperating with an associated said hinge bar to limit rotation of said cutter head guide bar assembly and said clamping frame to a lowered position at which the bottom surface of said guide plate is flush with, but is not resting with any significant weight upon, said picture frame mat which is resting on said mat-supporting surface, said clamping frame being selectively deformable by exerting downward pressure on said cutter head guide assembly, thereby to urge said guide plate into gripping engagement with said picture frame mat;

(c) a cutter head slidably mounted along said guide rod by means of a replaceable bearing block, said cutter head including spaced-apart longitudinal edges, one of said edges forming an acute angle to the plane of said base and the other forming approximately a right angle to the plane of said base, said cutter head including a pair of cutting blades pivotally carried thereby, one blade being disposed for guidance by, and cooperation with, each longitudinal edge of said cutter head; and (d) a pair of longitudinally spaced-apart, longitudinally slidably, adjustably, movable, fixable, but detachable stop means, each being mounted on said guide rod to limit to-and-fro slidable movement of said cutter head along said guide rod.

2. The mat cutter of claim 1 wherein said guide rod is journalled for rotation within an associated bearing block, each secured to an associated said transverse, lateral hinge bar.

3. The mat cutter of claim 1 wherein said longitudinally extending handle interconnecting the respective forward end of associated said transverse, lateral hinge bars comprises a hollow bar of generally rectangular cross section.

4. The mat cutter of claim 1 wherein each said hinge means comprises:

(a) a hinge member comprising a generally rectangular, transversely extending bar inset into a channel at a respective lateral edge of the base, said bar including a rectangular well adjacent its forward end, one longitudinally extending edge of said rectangular well defining said first stop means, and the other longitudinally extending edge of said rectangular well defining said second stop means, said central well being provided with a journal bore therein for accepting a hinge pin.

5. The mat cutter of claim 50 wherein each said hinge bar is provided with a depending bearing block, and wherein said guide rod is journalled for rotation within bearings disposed in said bearing block.

6. The mat cutter of claim 1 wherein said cutter head guide bar assembly comprises a guide plate, and a guide rod secured thereto on the upper surface thereof, said guide rod being journalled for selective rotation with respect to said transverse, lateral hinge bars through an angle of 45°.

7. The mat cutter of claim 1 wherein each said detachable stops comprise:

(a) a main body portion;

(b) a generally circular channel in the bottom thereof to enable slidable movement of said main body portion along said guide rod, and said channel including securement means for fixing said main body portion at a selected longitudinal position along said guide rod;

(c) a lower fixed stop bar secured to the bottom of said main body portion;

and (d) an upper movable stop bar provided with a projecting stop pin, said stop bar being adjustably slidably movable along the upper surface of said main body portion and said bar including fixing means for fixing said stop bar at a selected longitudinal position with respect to said main body portion.

8. The mat cutter of claim 7 wherein said fixing means for fixing said main body portion with respect to the guide rod comprises a set screw.

9. The mat cutter of claim 7 wherein said upper movable stop bar is slidably disposed within a longitudinal channel in the top surface of said main body portion and is held therein by a retaining plate, said main body portion including retaining means to retain said movable stop bar at any selected position with respect to said main body portion.

10. The mat cutter of claim 9 wherein said retaining plate is a transparent plastic plate, and wherein said retaining means comprises a set screw.

11. The mat cutter of claim 1 wherein said replaceable bearing block is formed of a structurally rigid, substantially frictionless synthetic material set into the base thereof.

12. The mat cutter of claim 11 wherein said edge forming approximately a right angle to the plane of said base is constituted by a vertical cutting head having said blade secured therein, said vertical cutting head being pivotally mounted along a generally vertical face disposed at a slight downwardly and inwardly directed angle, said vertical cutting head being spring biased to remain in an upper, non-engaged position.

13. The mat cutter of claim 12 wherein a side face of said blade which is held by said vertical cutting head is acted on by the internal end face of a set screw.

14. The mat cutter of claim 11 wherein said edge forming an acute angle to the plane of said base is constituted by a bevel cutting head having said blade secured therein, said bevel cutting head being pivotally mounted along a face disposed downwardly and outwardly at a 45° angle, said bevel cutting head being spring biased to remain in an upper, non-engaged position.

15. The mat cutter of claim 14 wherein a side face of said blade which is held by said bevel cutting head is acted on by the internal end face of a set screw.

16. The mat cutter of claim 1 including a squaring arm comprising:

(a) a "Tee" cross-section arm secured to the rear edge of the rectangular cutter base at exactly right angles thereto, by a flat base portion, said "Tee" cross-section arm having an upwardly extending arm;

(b) a production stop block adjustably slidably mounted on said "Tee" cross-section arm, said production stop block having retaining means to retain said production stop block at a selected location;

and (c) a retainer pin projecting from the inboard end of said production stop block.

17. The mat cutter of claim 16 including a scale secured to the upper surface of said flat base portion of said "Tee" cross-section arm.

18. The mat cutter of claim 1 including a mat border measuring and guide system comprising:

(a) a main support arm secured in a fixed position to the forward edge of said rectangular cutter base and extending at an angle of exactly 90° thereto;

(b) a main block slidably secured to said main support arm between the inboard end of said main support arm, said main block including securement means to retain said main block at a first selected position along said main support arm;

(c) a rectanglar extension arm adjustably slidably secured to the inboard end of said main block, said extension arm including securement means to retain said rectangular extension arm at a preselected position on said main block;

(d) a squaring ruler secured to the inboard end of said extension arm at exactly 90° thereto;

(e) a duplicator rod extending outwardly from said main block and including securement means to retain said duplicator rod at a preselected position relative to said main block;

(f) a duplicator block having a longitudinally extending bore slidably receiving said duplicator rod and being slidably secured to said main support arm inboard of said repeater block, said duplicator block including securement means to retain said duplicator block at a first selected position along said main support arm;

and (g) a repeater block having a longitudinally extending bore slidably receiving said duplicator rod and being slidably secured to said main support arm adjacent the rearward end thereof, said repeater block including securement means to retain said repeater block at a second, different selected position along said main support arm;

whereby said squaring ruler, said rectangular extension arm and said main block are slidable, as a unit, between a position a preselected distance from said duplicator block, said duplicator block being either a preselected distance from said repeater block, or abutting said repeater block.

19. The mat cutter of claim 18 wherein said main support arm comprises a rectangular bar having an engageable longitudinally extending edge.

20. The mat cutter of claim 19 wherein said repeater block comprises a block including a bottom, longitudinally extending channel to enable said repeater block to slide with respect to said rectangular bar, and wherein said securement means comprises a set screw passing through a side face of said repeater block for engagement with said engageable, longitudinally extending edge.

21. The mat cutter of claim 18 wherein said duplicator block comprises a block including a bottom, longitudinally extending channel to enable said duplicator block to slide with respect to said rectangular bar, and wherein said securement means comprises a set screw passing through a side face of said duplicator block for engagement with said engageable, longitudinally extending edge.

22. The mat cutter of claim 18 wherein said main block comprises a block including a bottom, longitudinally extending channel to enable said main block to slide with respect to said rectangular bar, and wherein said securement means comprises a set screw passing through a side face of said block for engagement with said engageable, longitudinally extending edge.

23. The mat cutter of claim 18 wherein said rectangular extension arm is secured to said main block by a pair of longitudinally extending slots therein through which a respective pair of screws pass, said screws being engageable in respective tapped apertures in said main block.

24. The mat cutter of claim 18 wherein said squaring ruler includes a slider pad adhered to the bottom surface thereof.

25. The mat cutter of claim 18 including:

(h) a groover block adjustably slidably mounted on said extension arm, said groover block including retainer means to retain it at a selected position relative to said extension arm.

26. The mat cutter of claim 25 wherein said main extension arm comprises a rectangular bar having an engageable, longitudinally extending arm; and wherein said groover block comprises a "Tee"-cross-section block, having an upwardly extending arm abutting a longitudinal side face of said main extension arm, and including a longitudinally extending slot in said main extension arm and a screw passing into a tapped aperture in said flat face.

27. The mat cutter of claim 18 wherein:

(a) said main support arm comprises a rectangular bar having an engageable longitudinally extending edge;

(b) said repeater block comprises a block including a bottom, longitudinally extending channel to enable said repeater block to slide with respect to said rectangular bar, and wherein said securement means comprises a set screw passing through a side face of said repeater block for engagement with said engageable, longitudinally extending edge;

(c) said duplicator block comprises a block including a bottom, longitudinally extending channel to enable said duplicator block to slide with respect to said rectangular bar, and wherein said securement means comprises a set screw passing through a side face of said duplicator block for engagement with said engageable, longitudinally extending edge;

(d) said main block comprises a block including a bottom, longitudinally extending channel to enable said main block to slide with respect to said rectangular bar, and wherein said securement means comprises a set screw passing through a side face of said block for engagement with said engageable, longitudinally extending edge;

(e) said rectangular extension arm is secured to said main block by a pair of longitudinally extending slots therein through which a respective pair of screws pass, said screws being engageable in respective tapped apertures in said main block;

(f) said squaring ruler includes a slider pad adhered to the bottom surface thereof; and including:

(g) a groover block adjustably slidably mounted on said extension arm, said groover block including retainer means to retain it at a selected position relative to said extension arm, said groover block comprising a "Tee"-cross-section block, having an upwardly extending arm abutting a longitudinal side face of said main extension arm by means of a longitudinally extending slot in said main extension arm and a screw passing into a tapped aperture in said flat face.

28. The mat cutter of claim 4 wherein each said transverse, lateral hinge bar comprises: a rearwardly projecting, downwardly extending leg pivotally secured by a hinge pin passing through a bore in said leg and said journal bore in said central well, and a forwardly extending integral, upper arm spaced a predetermined distance above said hinge means.

* * * * *